United States Patent [19]

McLaughlin

[11] Patent Number: 4,961,381

[45] Date of Patent: Oct. 9, 1990

[54] PRIMER CENTERING DEVICE FOR LARGE DIAMETER BLASTHOLES

[75] Inventor: Patrick D. McLaughlin, Fort McMurray, Canada

[73] Assignee: Suncor, Inc., North York, Canada

[21] Appl. No.: 350,829

[22] Filed: May 12, 1989

[30] Foreign Application Priority Data

Sep. 29, 1988 [CA] Canada ..... 578771

[51] Int. Cl.[5] ..... F42B 3/26; F42B 3/182

[52] U.S. Cl. ..... 102/319; 86/20.15; 89/1.15

[58] Field of Search ..... 102/319, 202.14, 302, 102/304, 313; 86/20.15; 89/1.15; 166/63

[56] References Cited

U.S. PATENT DOCUMENTS

| | | | |
|---|---|---|---|
| Re. 31,953 | 7/1985 | Calder, Jr. et al. | 86/20.15 |
| 1,218,140 | 3/1917 | Weber | 102/319 |
| 1,526,274 | 2/1925 | Fitzsimons et al. | 89/1.15 |
| 1,560,815 | 11/1925 | Hill | 89/1.15 |
| 2,923,238 | 2/1960 | Albon et al. | 102/319 |
| 3,276,371 | 10/1966 | Newman et al. | 102/319 |
| 3,357,355 | 12/1967 | Roush | 102/319 |
| 4,248,303 | 2/1981 | Charpentier | 166/63 |

FOREIGN PATENT DOCUMENTS

| | | | |
|---|---|---|---|
| 827427 | 11/1969 | Canada | 102/319 |
| 288460 | 11/1915 | Fed. Rep. of Germany | 102/304 |
| 1005017 | 3/1957 | Fed. Rep. of Germany | 89/1.15 |
| 422255 | 1/1935 | United Kingdom | 102/313 |
| 998757 | 7/1965 | United Kingdom | 102/319 |

*Primary Examiner*—Charles T. Jordan
*Assistant Examiner*—Stephen Johnson
*Attorney, Agent, or Firm*—Paul Lipsitz

[57] ABSTRACT

An improved method for reducing misfires in large diameter unlined blastholes by fitting on the primer used in the blasthole a centering device comprised of a semi-conducting plastic material.

7 Claims, 2 Drawing Sheets

PRIMER CENTERING DEVICE FOR LARGE DIAMETER BLASTHOLES

This invention is directed to reducing the "misfires" in large diameter unlined blastholes (also called boreholes) and is particularly concerned with spherical charge blastholes employed in the mining of oil sands.

BACKGROUND OF THE INVENTION

In the mining of oil sand for the extraction of bitumen therefrom, an essentially oil-sand free overburden is first removed and the underlying oil sand ore is mined with bucketwheels. This mining procedure comprises the setting of explosive charges in the ore which charges are detonated to break up the ore and the resulting chunks of oil sand are dug up with large bucketwheels, dropped on a moving belt, and conveyed to the extraction units of the processing plant. In order to set the explosive charges, it is necessary to drill large diameter boreholes of about 6 to about 30 inches, place about one-half of the explosive in the hole, introduce a primer needed to set off the explosive and then complete the filling of the hole with the explosive after which the explosive is set off. For optimum results, i.e., to obtain a maximum cratering effect a spherical charge geometry is used with a charge length to charge diameter ratio of six or less. In such a charge, the energy produced by the expanding gases after detonation is directed radially outward from the center of the charge in all planes passing through the center, and it moves with a uniform, spherically diverging motion. As long as the ratio of the diameter of the borehole to the charge length of the borehole is 1 to 6, the breakage mechanism and the results are practically the same as with a true spherical charge.

In carrying out such procedures, however, two major problems are encountered. One problem is due in part to the moisture at the perimeter of the borehole due to the percolation of water along the outside of the powder column by methane gas. Thus, when or after the primer is introduced and the borehole filled with powder, the primer often becomes postioned adjacent to the borehole wall in the wet, insensitive zone. When this happens, the hole does not shoot thus effecting a "misfire." When this occurs, the holes must be dug out with a backhoe and frequently the holes which misfired are unknown and adversely affect the bucketwheel excavators when they dig the unexploded material.

A second problem with the conventional method of preparing the blasthole for detonation is due to the static charges which build up and can cause a premature, unintended explosion of the methane gas. It is obvious that these problems create hazards and undue costs in the mining operation.

BRIEF STATEMENT OF THE INVENTION

A novel means has been found to overcome the problems of "misfires" and premature explosions as discussed above which comprises fitting the primer which is to be used in large blastholes with a centering device comprised of a semi-conducting plastic material.

DISCUSSION OF THE PRIOR ART

U.S. Pat. No. 710,323, (1902) discloses an oil well torpedo of about 4 to 5 inches in diameter fitted with a rubber cylindrical body adapted to fit over the torpedo casing and thereby act as a guide in passing the torpedo shell through the well casing to avoid the friction and jarring incident to such operation, thus avoiding premature explosion of the nitroglycerine in the torpedo due to friction.

U.S. Pat. No. 4,699,060 discloses a detonation arrestor device for bulk explosive materials transfer comprising a hose having a central channel disposed therein held in place by a centering ring in order to have explosive material pass along the outside of the channel and cause any fumes generated by an unintentional explosion to pass along the inside of the hose.

U.S. Pat. No. 2,491,692 relates to a borehole explosive charge adapted to have wall engaging fingers to prevent the charge moving upwardly from its desired depth in the borehole.

BRIEF DESCRIPTION OF THE INVENTION

The invention comprises a method for reducing or eliminating misfires in large diameter, unlined blastholes which comprise fitting a centering device on the primer casing used in the blasthole, which device is made from a semi-conducting plastic material such as a carbon impregnated polypropylene.

DETAILED DESCRIPTION OF THE INVENTION

Figure 1:
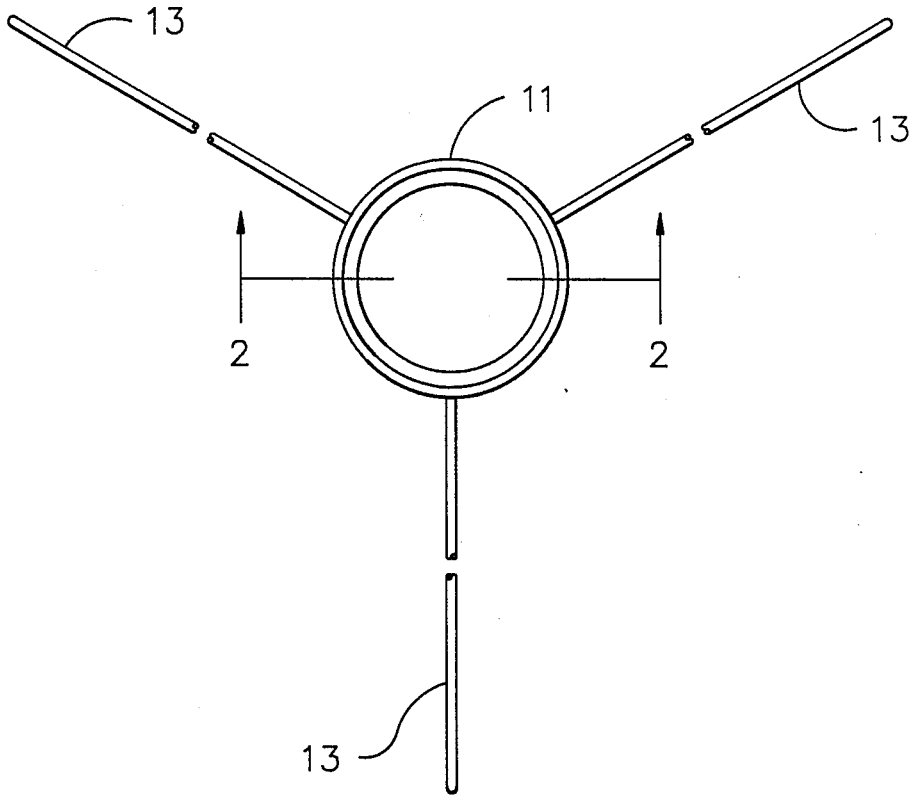
FIG. 1 is a planar view of the centering device used in the invention.

Referring to FIG. 1, it is seen that the centering device used in the invention comprises a circular ring (11) with three fingers or spikes (13) symmetrically located around the ring. These spikes extend from the ring to the perimeter of the blasthole and thereby center the primer within the blasthole. While the dimensions of the device may vary, it will generally have an inside diameter appropriate to fit over the casings of conventional primers which range from 1 inch to 5 inches. The spikes (13) will vary with the blasthole diameter, but will generally be adapted to fit a blasthole of from about 6 to about 30 inches. Of course, the centering device may be made with longer spikes and cut to size in the field. Three spikes are shown in FIG. 1, but, of course, any plurality of spikes or even a disc may be used.

Figure 2:
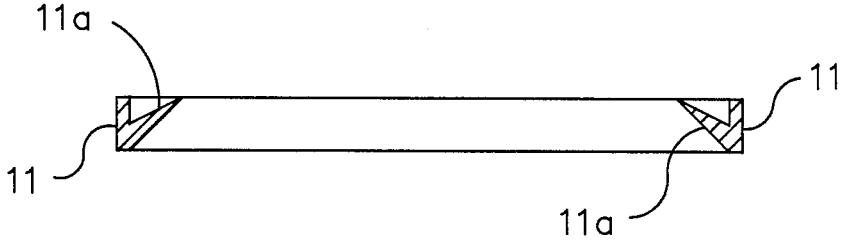
FIG. 2 is a front elevational section taken along lines 2—2 of the device shown in FIG. 1.

As seen in FIG. 2, the centering device is relatively thin and need be only of a thickness to give sufficient rigidity to support the spikes. As can be seen in FIG. 2, a flexible inner lip (11*a*) on the inside perimeter of the disc (11) ensures that the centering device will fit tightly over the primer case.

Figure 3:
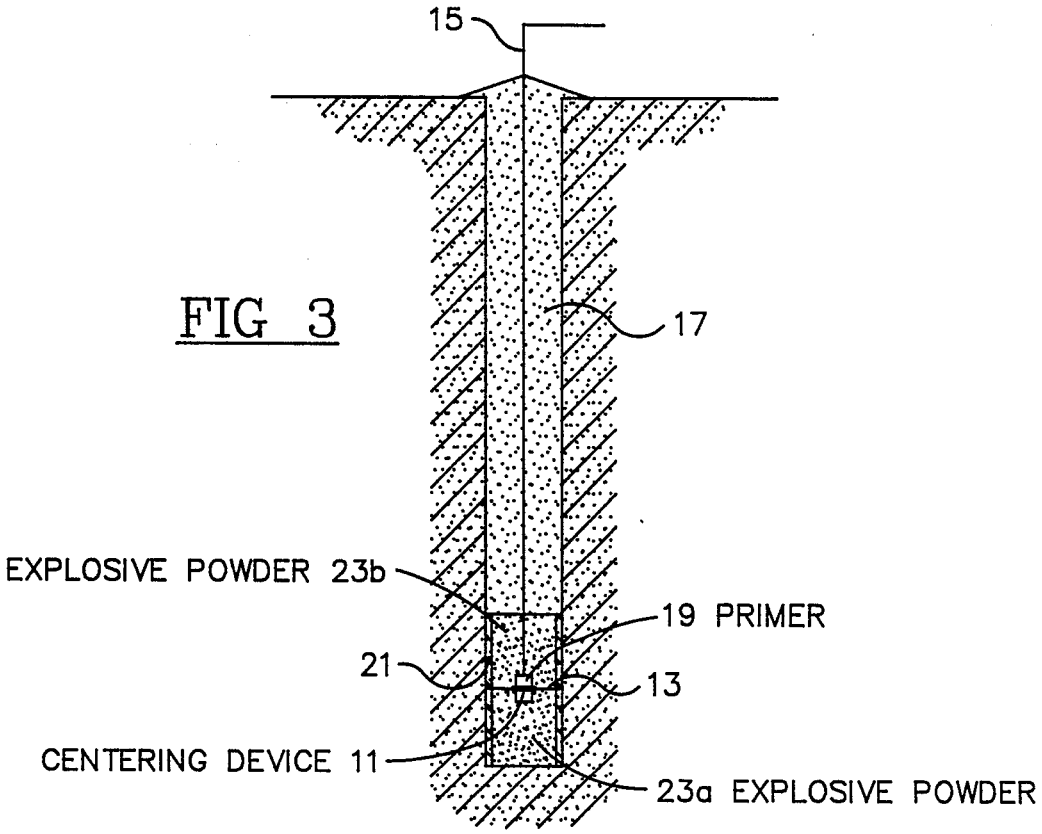
FIG. 3 shows the device in use around a primer casing in a blasthole.

FIG. 3 shows the centering device in use. A detonating cord (15) in a blasthole (17) supports a primer (19) around which is the centering device (11) having extending spikes (13). In operation, the blasthole is first filled with the explosive powder to about half of the desired amount (23*a*), the primer with the centering device then lowered and the remainder of the powder (23*b*) added. In order to achieve a maximum cratering effect, a spherical charge geometry is employed and this is achieved by using a charge length to charge diameter of six or less. Detonation of the charge is then carried out in the usual way.

Figure 4:
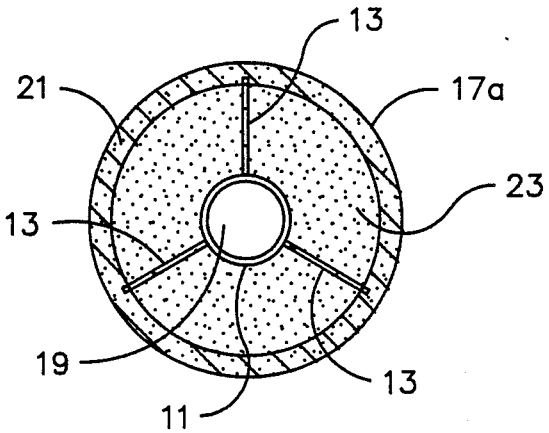
FIG. 4 is a planar view of the centering device in the blasthole.

FIG. 4 illustrates a planar view (but not to scale). As can be seen, peripheral to the blasthole wall (17*a*) is the wet zone (21) which, in turn, surrounds the healthy explosive core (23). The centering device (11) with spikes (13) maintain the primer in the healthy explosive core so that it cannot contact the wet zone (21) where the powder is deactivated.

The centering device used in the invention may be made of various materials, but preferably will be made of plastic. Manufacture of the device is readily accomplished by injection molding or other conventional means.

A preferred material for making the centering device is a semi-conducting plastic, i.e., a plastic having a resistance in the 10,000 ohm range. Such a material is advantageous in that it dissipates any build-up of static charge in the blasthole caused by the loading of the explosive powder. This static charge in the blasthole can cause ignition of the methane-air mixtures which occur in the blasthole and which, when ignited, cause premature ignition and other difficulties. Thus, a carbon filled plastic or other type of conductive plastic is the material of choice for making the centering device.

Another condition significant to the use of the centering device is the climate where the oil sand is mined. Because of the extreme cold during the winter months, the plastic or other material from which the centering device is made should have good cold-weather properties, i.e., it should maintain its structural stability; i.e., it should not get brittle and break at temperatures of about −40° F. and it should also remain rigid at higher temperatures of about 100° F. which is also common at the mine site. For these reasons, the preferred material for the centering device will be a carbon-filled polyethylene or polypropylene meeting the above criteria.

I claim:

1. A method for reducing misfires in unlined blastholes having a diameter of about 6 to about 30 inches where an explosive charge is detonated by a primer within a casing which comprises:

(a) partially charging an unlined blasthole of said unlined blastholes with explosive powder, (b) supporting a primer at a top of said charge of explosive powder, centering said primer in said blasthole by a centering device affixed to the casing of said primer, dissipating static charge accumulated in said blasthole by said centering device being made of a semi-conducting material having a resistance of about 10,000 ohms, (c) completing the charge of powder in said blasthole and, (d) detonating said charge of explosive powder.

2. The method of claim 1 maintaining structural stability of said centering device at temperatures between about −40 degrees F. and 100 degrees F.

3. The method of claim 1 selecting the centering device to be made of a carbon filled polymer wherein said polymer is selected from the group consisting of polyethylene and polypropylene.

4. In combination, a primer within a casing used for initiating an explosive in a blasthole and a centering device for said primer comprising a circular ring adapted to fit over the casing of said primer, said ring being made of a semi-conducting material having a resistance of about 10,000 ohms and having a plurality of spikes extending from said ring and of a length sufficient to keep said primer in a center of said blasthole.

5. The combination of claim 4 wherein said ring has a flexible inner lip to assure a tight fit of said ring around the casing of said primer.

6. The combination of claim 5 wherein the centering device is made of a carbon filled polymer wherein said polymer is selected from the group consisting of polyethylene and polypropylene.

7. A method for reducing misfires in unlined blastholes having a diameter of about 6 to about 30 inches where an explosive charge is detonated by a primer within a casing which comprises:

(a) partially charging an unlined blasthole of said unlined blastholes with explosive powder, (b) supporting a primer at a top of said charge of explosive powder, centering said primer in said blasthole by a centering device affixed to the casing of said primer, dissipating static charge accumulation in said blasthole by said centering device being made of a carbon filled semi-conducting material having a resistance sufficient to dissipate any build-up of static charge, (c) completing the charge of powder in said blasthole and, (d) detonating said charge of explosive powder.

* * * * *